US012319390B1

(12) United States Patent
Clary et al.

(10) Patent No.: US 12,319,390 B1
(45) Date of Patent: Jun. 3, 2025

(54) ADJUSTABLE RACK FOR RECREATIONAL EQUIPMENT USED ON LAKES

(71) Applicant: CLARY LAKE SERVICE, INC., Milford, IA (US)

(72) Inventors: Chad Clary, Milford, IA (US); Jeff Schwarck, Milford, IA (US)

(73) Assignee: CLARY LAKE SERVICE, INC., Milford, IA (US)

( * ) Notice: Subject to any disclaimer, the term of this patent is extended or adjusted under 35 U.S.C. 154(b) by 248 days.

(21) Appl. No.: 18/053,110

(22) Filed: Nov. 7, 2022

(51) Int. Cl.
*B63B 32/83* (2020.01)
*B63C 3/06* (2006.01)

(52) U.S. Cl.
CPC ..... *B63B 32/83* (2020.02); *B63C 3/06* (2013.01)

(58) Field of Classification Search
CPC ..... B63B 32/83; B63C 3/06
See application file for complete search history.

(56) References Cited

U.S. PATENT DOCUMENTS 2,687,814 A * 8/1954 Romick ..... B63C 15/00 414/331.14
3,753,355 A * 8/1973 Knoch ..... B63C 3/06 405/3
4,900,187 A * 2/1990 Uchida ..... B63C 3/06 405/2
5,628,583 A * 5/1997 Gibson ..... B63C 3/06 405/3
6,161,999 A 12/2000 Kaye et al.
6,253,932 B1 * 7/2001 Lindsey ..... B63C 15/00 211/13.1
7,152,535 B2 12/2006 Mikich et al.
D553,401 S 10/2007 Peddycord
7,357,262 B2 4/2008 Fratilla
D697,785 S 1/2014 Davis
D716,581 S 11/2014 Davis
9,278,735 B1 * 3/2016 Gaiser ..... B63C 3/12
D756,145 S 5/2016 Davis
9,527,562 B1 * 12/2016 Sterling ..... B63C 15/00
D781,614 S 3/2017 Taylor
(Continued)

OTHER PUBLICATIONS

"The Docksider," Assembly Installation, Setup, and Operating Instruction, OM100, Dock Suface Mount Models; Series 100, DockCraft Industries LLC, 2021, 14 pages.
(Continued)

*Primary Examiner* — Janine M Kreck
(74) *Attorney, Agent, or Firm* — McKee, Voorhees & Sease, PLC

(57) ABSTRACT

A rack for aquatic recreational equipment comprises an adjustable frame comprising a left-side member, a right-side member, and at least one horizontal member extending from the left-side member to the right-side member; at least two pairs of opposing arms extending away from the left-side member and the right-side member; a mounting member operatively attached to (i) the adjustable frame and (ii) a dock, said mounting member orthogonally oriented with respect to a plane defined by an adjacent water surface; and a lifting assembly comprising a slider-crank mechanism to translate rotational movement of a rotatable handle to linear movement of the adjustable frame, thereby allowing for a change in height of the adjustable frame with respect to the adjacent water surface.

13 Claims, 4 Drawing Sheets

(56) References Cited

U.S. PATENT DOCUMENTS

| | | | | |
|---|---|---|---|---|
| 9,669,907 | B2 | 6/2017 | Field | |
| 10,315,739 | B1 * | 6/2019 | Davis, Jr. | B63C 1/12 |
| 10,377,454 | B2 * | 8/2019 | Surges | B63C 3/06 |
| 10,897,992 | B2 | 1/2021 | Vandenham et al. | |
| 2007/0193966 | A1 | 8/2007 | Dettorre | |
| 2010/0104365 | A1 * | 4/2010 | Wood, II | B63C 3/06 405/3 |
| 2018/0257748 | A1 * | 9/2018 | Gugin | A63B 71/0036 |
| 2022/0355910 | A1 * | 11/2022 | Skutnik | B63C 15/00 |

OTHER PUBLICATIONS

"The Docksider," Assembly Installation, Setup, and Operating Instruction, OM200, Tool Free Dock Mount Models; Series 200, DockCraft Industries LLC, 2021, 13 pages.

"The Docksider," Assembly Installation, Setup, and Operating Instruction, OM300, ShoreMaster Mount Models; Series 300, DockCraft Industries LLC, 2021, 12 pages.

"The Docksider," Assembly Installation, Setup, and Operating Instruction, OM400, Beach King Mount Models; Series 400, DockCraft Industries LLC, 2021, 11 pages.

Paddleboard Rack—Installation Instructions, SafeRacks, Eagle Industrial Group Inc., 2015, 4 pages.

* cited by examiner

ADJUSTABLE RACK FOR RECREATIONAL EQUIPMENT USED ON LAKES

TECHNICAL FIELD

The present disclosure relates generally to an apparatus for recreational equipment used on lakes. More particularly, but not exclusively, the present disclosure relates to a dynamic rack for holding paddleboards.

BACKGROUND

The background description provided herein gives context for the present disclosure. Work of the presently named inventors, as well as aspects of the description that may not otherwise qualify as prior art at the time of filing, are neither expressly nor impliedly admitted as prior art.

Great care must be taken to store many types of recreational equipment. Paddleboards in particular can be up to ten feet to twelve feet (10 ft.-12 ft) long and can weigh more than twenty pounds (20 lb), which makes storing the paddleboard and quickly removing the paddleboard from storage no easy task. The importance of storing a quality paddleboard in optimal conditions can be exacerbated by the substantial investment that is often required to purchase the board.

Perhaps the simplest solution is to lean the board up against a wall, though storing the board against a wall takes up valuable space that could otherwise be used for other purposes. The board is most often placed down on its side or its tail to avoid potential pressure points. The board must be placed in an area where the not be confined and/or pinched, as long-term pressure can deform the board. Padding must be placed between the board and the wall/floor to protect the board. Even in situations where the board is leaned up against a wall, the need to secure the board with a strap or a wooden peg on each side is not necessarily obviated. Straps and pegs can prevent the board from slipping from a secured position and crashing down onto the floor. Persons trafficking the area near boards that are leaned up against a wall must also take care not to inadvertently contact the board, otherwise, again, the board can come crashing down onto the floor.

Transport of the board(s) into and out of an indoor location from an outdoor location can cause damage to the board, the building's structure, and/or other objects located within the building. Keeping these boards indoors on shelves is therefore not always the most optimal solution. Outdoor storage of a board is acceptable, so long as the board is protected from sun, moisture, and heat.

These many issues have thus led many to utilize complex storage systems to store the board when the board is not in use. Known storage systems use in marinas and garages of lake homes do not facilitate quick and easy use of recreational equipment during the summer season.

To avoid taking up too much space, one solution is to permanently affix shelves high up on walls to allow keep the recreational equipment away from highly trafficked areas during storage. These shelves, if not installed correctly, can cause injury if the shelves and/or recreational equipment inadvertently falls from height. Most shelves are needlessly bulky in comparison to the benefits they provide for storage and require a long platform(s) that must be supported by a large frame. The large frame then needs to be secured to the wall and/or suspending from the ceiling. Fasteners that attach the frame to the wall must be capable of supporting not only the weight of the shelves, but the recreational equipment stored thereon.

Known shelving systems are also not generally adjustable in width and length and do not accommodate many different types of boards and/or other recreational equipment. Known shelves that are adjustable are only limitingly adjustable and require great effort to be adequately adjusted. For example, smaller shelves can be spaced apart from one another and moved from one mountable position to the next along various intervals on the wall. The mounting and movement of these smaller shelves requires extensive hardware and can permanently and irreversibly alter and damage the building's structure (e.g., wall/ceiling) therebencath.

Most indoor shelves contact the board across the body of the board, rather than "cradling" the board along its edge. This has led many to try to store boards using cradles and/or other types of more complex storing systems. For example, U.S. Pat. No. 9,669,907 discloses one type of a retractable storage rack system that is suspended from a ceiling and is used for storing sports boards including surfboards. While hanging your board from the ceiling is a good way to get the board up and out of the way, proper securement requires the purchase of a suspension system designed just for the type of recreational equipment bought, the additional purchase of wide webbing straps, and great effort must be expended to get the board into and out of the secured position such that the hull of the board faces up toward the ceiling (i.e., in an optimal storage position).

Even cradling systems that are employed near a dock are generally deficient because they are merely static in nature. In other words, they cannot lower into and rise out of the water to launch and receive recreational equipment from a nearby body of water. Rather, the recreational equipment must be lifting by hand out of the rack and placed into the water.

Thus, there exists a need in the art for a dynamic rack that allows for the storage and facile launching of recreational equipment into an adjacent body of water.

SUMMARY

The following objects, features, advantages, aspects, and/or embodiments, are not exhaustive and do not limit the overall disclosure. No single embodiment need provide each and every object, feature, or advantage. Any of the objects, features, advantages, aspects, and/or embodiments disclosed herein can be integrated with one another, either in full or in part.

It is a primary object, feature, and/or advantage of the present disclosure to improve on or overcome the deficiencies in the art.

It is a further object, feature, and/or advantage of the present disclosure to translate rotational movement of a hand crank to linear movement in an adjustable frame so as to allow for a change in height of the adjustable frame with respect to a water level of an adjacent body of water. This can be particularly beneficial where the water level of the adjacent body of water is highly variable and thus requires a user to drop recreational equipment into the water at various elevations.

It is still yet a further object, feature, and/or advantage of the present disclosure to provide for the storage of a wide variety of recreational equipment. For example, the rack can be configured to accommodate paddleboards of various sizes and other types of leisure equipment used on lakes, including surfboards, kiteboards, kayaks, canoes, rafts, floats, smaller watercraft, dinghies, and the like.

It is still yet a further object, feature, and/or advantage of the present disclosure to evenly distribute the weight of recreational equipment stored on the adjustable frame of the rack. In this way, kayaks, dinghies, and paddle boards of more than 125 pounds can be supported by the arms of the rack.

It is still yet a further object, feature, and/or advantage of the present disclosure to minimize the amount of equipment needed for installation/assembly and/or deconstruction/disassembly of the rack. For example, in some embodiments the rack can install onto existing posts of a dock with nothing more than traditional fasteners (e.g., screws, bolts, nuts, washer) and a drill.

It is still yet a further object, feature, and/or advantage of the present disclosure to allow the rack to mount to the dock in the most facile manner. For example, the rack can mount to the top of the dock, which can be convenient where the underside of the dock is not accessible.

It is still yet a further object, feature, and/or advantage of the present disclosure to promote handling of the recreational equipment from both the waterside and the dockside of the rack.

It is still yet a further object, feature, and/or advantage of the present disclosure to protect against theft of recreational equipment stored on the rack in situations where the rack is left unattended. For example, built-in locks can be located on the frame of the rack to allow for heavy-duty securement intended only to be undone through use of a passcode, combination, key, and the like.

It is preferred the apparatus be safe, cost effective, and durable. For example, the rack can be adapted to resist excessive heat, static buildup, corrosion (e.g., rust), and/or mechanical failures (e.g., cracking, crumbling, shearing, creeping) due to excessive impacts and/or prolonged exposure to tensile and/or compressive forces acting on the rack. Such durability aids in weatherproofing the rack. In some embodiments, the rack can be adapted to withstand winter conditions so that it can be installed on year-round docks. A powder-coated aluminum built for the elements can help in this regard.

In yet another example, rollers can be employed on the frame of the rack to prevent damage to the sides of recreational equipment stored thereon.

At least one embodiment disclosed herein comprises a distinct aesthetic appearance. Ornamental aspects included in such an embodiment can help capture a consumer's attention and/or identify a source of origin of a product being sold. Said ornamental aspects will not impede functionality of the rack.

Methods can be practiced which facilitate use, manufacture, assembly, maintenance, and repair of a rack which accomplish some or all of the previously stated objectives.

The rack can be incorporated into systems which accomplish some or all of the previously stated objectives. For example, the racks described herein can also be attached at the side of a large watercraft, such as a pontoon or a yacht.

These and/or other objects, features, advantages, aspects, and/or embodiments will become apparent to those skilled in the art after reviewing the following brief and detailed descriptions of the drawings. The present disclosure encompasses (a) combinations of disclosed aspects and/or embodiments and/or (b) reasonable modifications not shown or described.

BRIEF DESCRIPTION OF THE DRAWINGS

Several embodiments in which the present disclosure can be practiced are illustrated and described in detail, wherein like reference characters represent like components throughout the several views. The drawings are presented for exemplary purposes and may not be to scale unless otherwise indicated.

An artisan of ordinary skill in the art need not view, within isolated figure(s), the near infinite distinct combinations of features described in the following detailed description to facilitate an understanding of the present disclosure.

DETAILED DESCRIPTION

The present disclosure is not to be limited to that described herein. Mechanical, electrical, chemical, procedural, and/or other changes can be made without departing from the spirit and scope of the present disclosure. No features shown or described are essential to permit basic operation of the present disclosure unless otherwise indicated.

Dock & Pier

As used herein, the pier is the manmade structure that allows for persons access to an adjacent body of water. The "dock", as used herein, refers to the pier and to the immediate area of water between or next to the pier.

Figure 1:
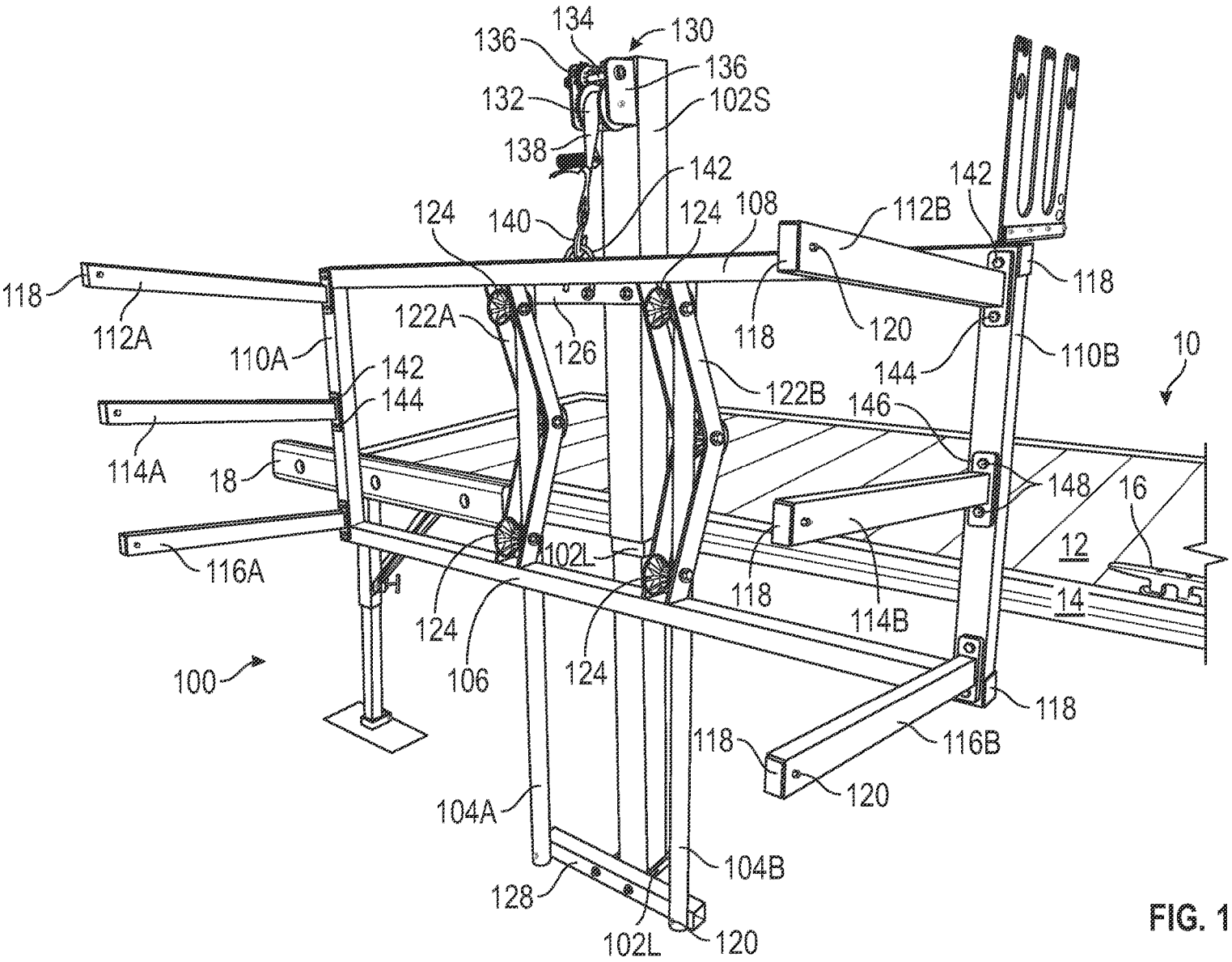
FIG. 1 shows a front perspective view of an adjustable rack for storing and launching recreational aquatic equipment in an adjacent body of water, according to some aspects of the present disclosure.

As shown in FIG. 1, the dock 10 is intended to facilitate in the handling of boats or ships (usually on or near a shore). The dock 10 includes planks 12, which are generally a long, thin, flat pieces of timber, used as flooring for persons to walk on. The planks 12 can be formed from wood, composite wood, vinyl and aluminum. In some embodiments, the dock 10 can instead be integrally formed from a single material, such as concrete.

The dock's edge can be protected by an aluminum plate/guard 14 that provides a tough, yet attractive and economical way to protect the dock's edge from damage caused by the light impact of day-to-day traffic. Aluminum edge guards can be formed from anodized aluminum or un-anodized aluminum, depending on the application. To protect the dock against heavier impacts, bumpers 18 attached to the dock 10 can be employed. The bumpers 18 are designed to cushion and protect a boat's bow, other hull areas, and the dock 10 itself when the boat comes near the dock 10. The bumpers 18 are distinct from the inflatable boat fenders (which are sometimes referred to as "boat bumpers"). Boat fenders are inflatable vinyl chambers that cushion and protect boat hulls when they come up against pilings, docks and other boats.

The dock 10 includes cleats 16 that allow said boats to be tied thereto. Specifically, a horn cleat is shown, featuring two "horns" extending parallel to the deck or the axis of the spar. The cleat 16 is attached to a flat surface or a spar, and resembles an anvil.

Still, it is to be appreciated that other types of cleats can be employed without departing from the scope of the present disclosure. For example, a cam cleat, a cleat in which one or two spring-loaded cams pinch the rope, allowing the rope to be adjusted easily, and quickly released when under load, can be used. In yet another example, a jam cleat, a cleat in which the line is pinched in a v-shaped slot, can be used. In yet another example, a clam cleat, a cleat in which the rope is held between two fluted stationary pieces, can be used. The clam cleat vaguely resembles two halves of a clam shell held back to back. The clam cleat is more compact than a cam cleat, but the rope is less easily released under load.

Figure 2:
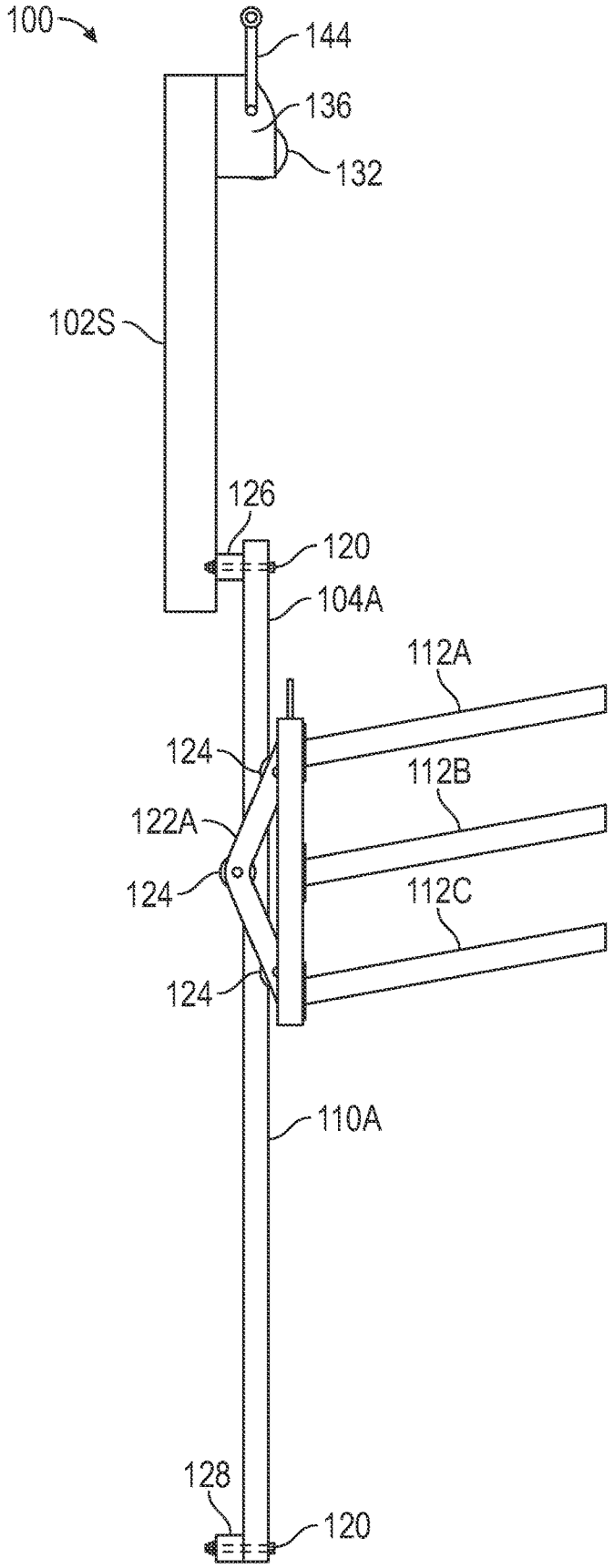
FIG. 2 shows a left-side elevation view of the rack of FIG. 1.
Figure 3:
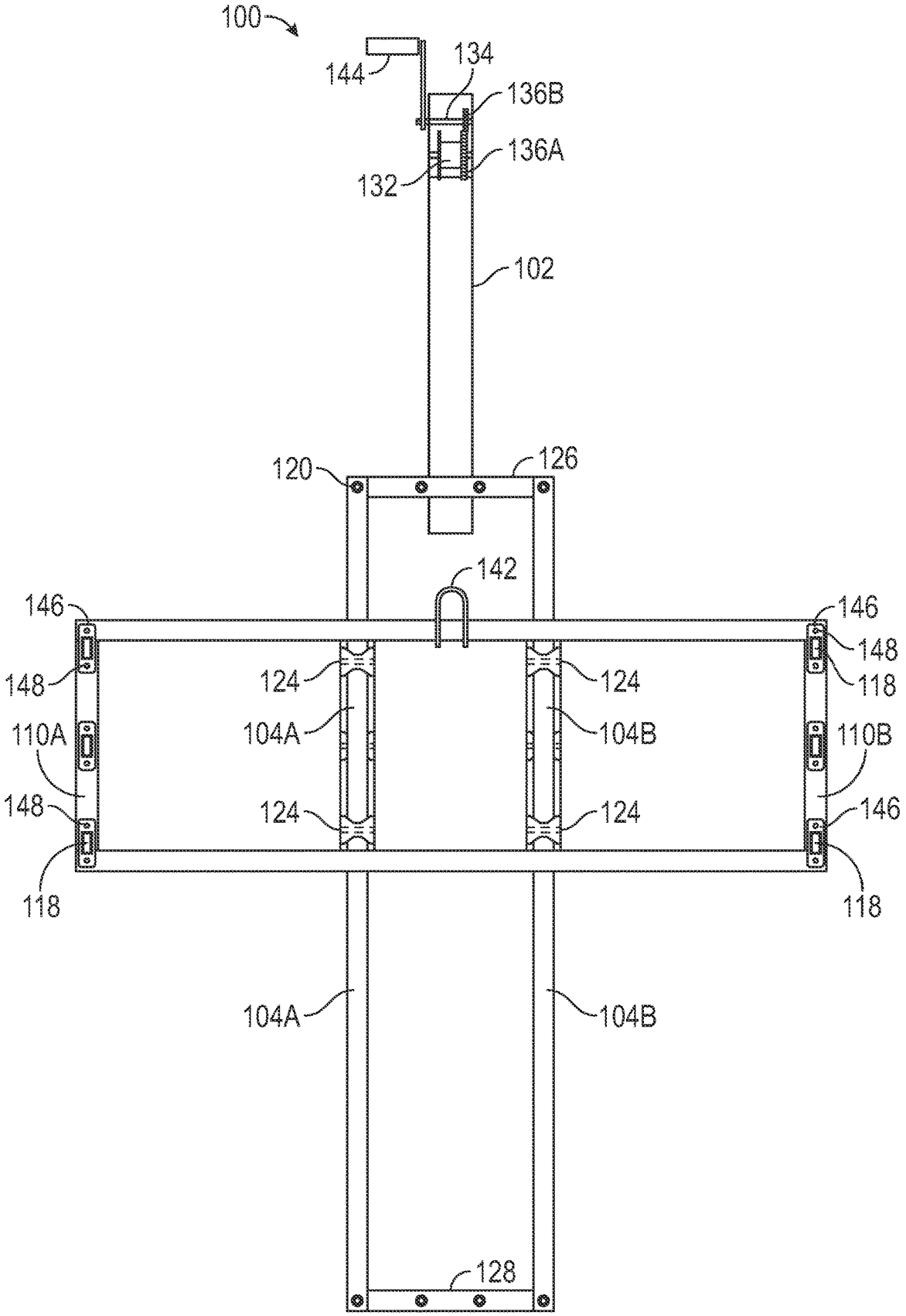
FIG. 3 shows a front elevation view of the rack of FIG. 1.
Figure 4:
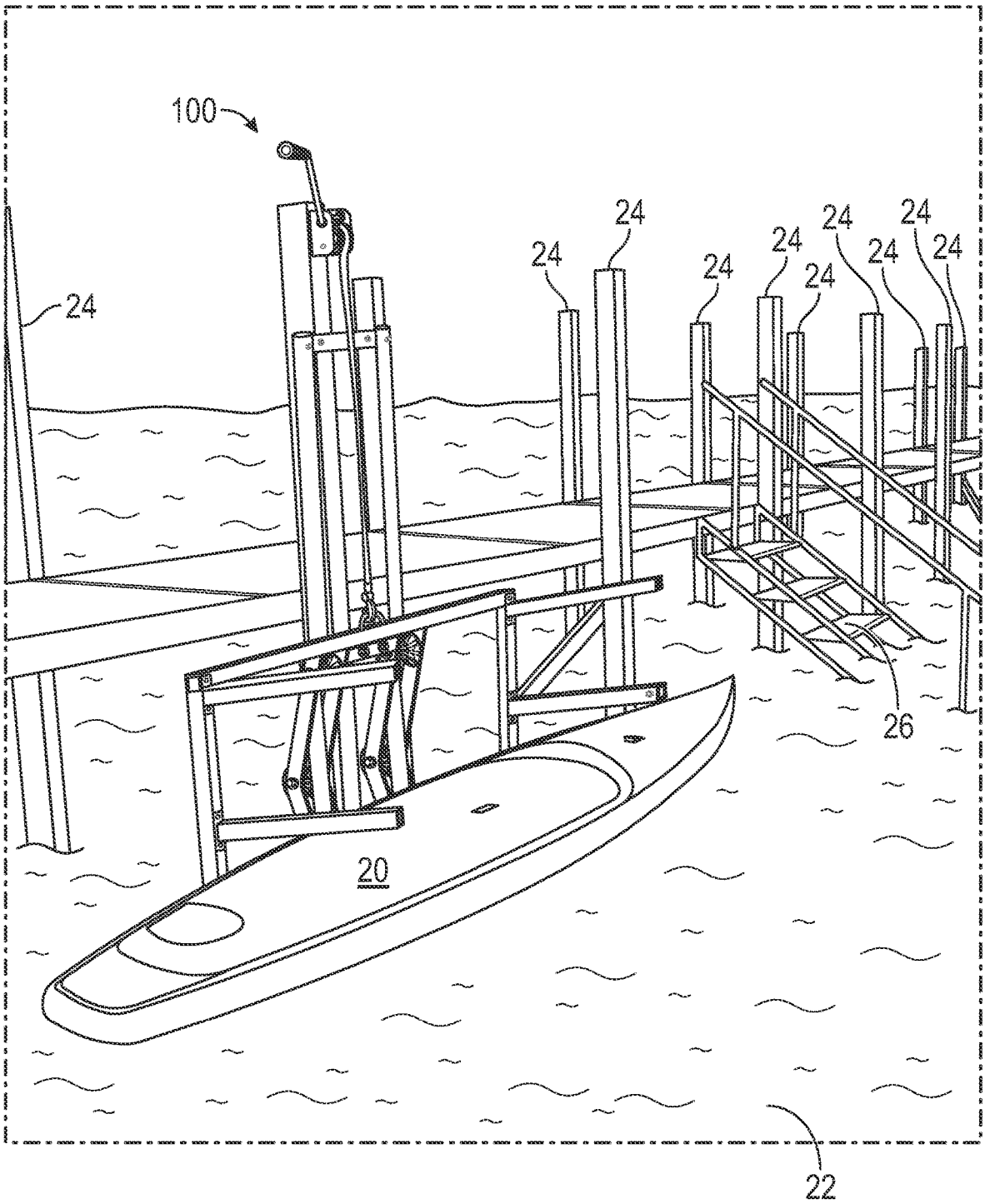
FIG. 4 shows an environmental view of the rack of FIG. 1 lowered to allow for the launch of a paddleboard at water level.

As shown in FIGS. 1 & 4, suitable aspect(s) of the dock 10 act as the structure which allow for attachment to the rack 100, which is shown in more detail throughout FIGS. 1-3 and discussed infra.

Further, as shown in FIG. 4, the recreational equipment 20 can include, but is not limited to including: surfboards, kiteboards, kayaks, canoes, rafts, floats, smaller watercraft, dinghies, and any other suitable type of recreational equipment that can be used on a body of water 22. The body of water 22 can be, but is not limited to being, an ocean, gulf, bay, sea, lake, pond, river, and/or stream.

The posts 24 are sturdy pilings used to support and the dock 10. To install the posts 24, either (i) heavy equipment can be used to drive the pilings into the ground, (ii) a jet of water to dig a deep hole for the pilings; or (iii) the pilings can be set in concrete footers. Pressure-treated wood and/or concrete are good materials to form the posts 24. The pilings are preferably placed at least five feet beneath the floor of the body of water for small walkways, at least eight feet for a dock that accommodates a large deck or a boat lift, and at least ten feet for docks that are on open water with much wave activity.

Steps 26 can be attached to the dock 10 to allow for one or more persons access to the water 22. The steps 26 can be the steps commonly employed by many different types of stairs and/or ladders. The steps 26 can be crafted from heavy-duty, marine-grade materials and should be able to a maximum weight capacity of at least three hundred pounds (300 lb). The steps 26 can include extruded aluminum channels that are serrated and produce a nonskid surface with no sharp edges. In some embodiments, the steps 26 extend at least two feet (2 ft) into the water 22, while in other embodiments, the steps extend at least four feet (4 ft) into the water 22.

Adjustable Rack

The rack 100 is shown in detail FIGS. 1-3. The rack 100 is shown further employed in an intended environment in FIG. 4. The rack 100 includes at least one mount that allows the rack 100 to attach to a post 24 of the pier.

In a first example, an upper, central sleeve 102S of the rack 100 slides over one of the 4×4 posts 24 of the dock 10 to allow attachment thereto.

Additionally, or in lieu of the central sleeve 102S, linking members 102L (e.g. hose clamps, banding clips, collars, etc.) are designed to encompass the outer perimeter of the post 24. The linking members 102L further allow for the rack 100 to attach to one of the 4×4 posts 24 of the dock 10 at various elevations. In some embodiments, the linking members 102L can slide to different elevations along the post 24 and/or another vertical member of the rack itself as the rack 100 is adjusted in height. The linking members 102L, like many other members of the rack 100, can be attached to the post by standard threaded fasteners 120, such as screws, bolts, nuts, washers, and the like.

The adjustable frame preferably includes a left-side depth support 104A, a right-side depth support 104B, a lower frame member 106, an upper frame member 108, a left frame member 110A, and a right frame member 110B. As shown, the lower frame member 106 and the upper frame member 108 extending from the left-side member 110A to the right-side member 110B. In some embodiments, it is completed that either only one horizontal member: either the lower frame member 106 or the upper frame member 108, is needed to support the adjustable frame as a hole. In still other embodiments where only a single horizontal member is needed, this horizontal member can be more centrally located than the lower frame member 106 and the upper frame member 108 shown in FIGS. 1-3. Pairs of opposing arms 112A-B. 114A-B. 116A-B extend away from the left-side member 110A and the right-side member 110B, toward the body of water 22.

The pairs of opposing arms 112A-B. 114A-B. 116A-B are placed at various elevations to fit various sizes and styles of recreational equipment. In some embodiments, the opposing arms 112A-B. 114A-B, 116A-B are removable to accommodate recreational equipment of greater heights than boards, such as kayaks. For example, a series of fasteners 120, mounting plates 146, and mounting apertures 148 in the mounting plates 146 and left and right frame members 110A, 110B can establish such a removable connection.

The opposing arms 112A-B. 114A-B, 116A-B are preferably rated to withstand a weight of recreational equipment of one hundred twenty five pounds (125 lb), more preferably to withstand two hundred pounds (200 lb), and most preferably to withstand two hundred seventy five pounds (275 lb). In some embodiments, each pair of opposing arms 112A-B. 114A-B, 116A-B are identically rated to withstand the same maximum weight. In other embodiments, lower pair(s) of opposing arms 114A-B. 116A-B are rated to withstand more weight than that of higher pair(s) of opposing arms 112A-B. 114A-B. This is so that when the higher pair(s) of opposing arms 112A-B. 114A-B are removed, larger recreational equipment, which typically weights more, is easily accommodated.

Because the pairs of opposing arms 112A-B. 114A-B. 116A-B are generally hollow to help reduce the weight of same, water-tight end caps 118 (e.g. gaskets) can be placed at distal ends of the pairs of opposing arms 112A-B. 114A-B. 116A-B to prevent excess moisture from seeping thereinto.

Optionally, auxiliary, vertical support arms 122A, 122B can extend from the lower member 106 to the right-side member 108. As shown, the auxiliary, vertical support arms 122A. 122B are dual member arms that attached at a pivot point (an elbow). The obtuse angle between each of the bifurcated sections of the auxiliary, vertical support arms 122A, 122B created at said elbow is between ninety degrees (>90°) and one hundred and eighty degrees (<180°), preferably between one hundred five degrees (>105°) and one hundred sixty five degrees (<165°), more preferably between one hundred thirty five degrees (>135°) and one hundred sixty five degrees (<165°), and most preferably approximately one hundred fifty degrees (~150°).

Rollers 124 and/or inflatable boat fenders can be employed on the frame of the rack 100 to prevent damage to the sides of recreational equipment 20 stored thereon. The rollers 124 can be dispersed throughout the frame. The rollers 124 are preferably horizontally oriented and equidistantly positioned about a central location with respect to each auxiliary support arm 122A, 122B. Beneficially, the rollers 124 can comprise spacers and/or dampers located therewithin. The spacers can, as an example, comprise deformable, outwardly biased pins that are outwardly biased (away the dock 10). When pushed slightly inward by the recreational equipment 20, the outwardly biased pins will allow the wheels to similarly be pushed inward such that when recreational equipment 20 is being loaded or unloaded from the frame, the fit between the base of the recreational equipment 20 and the frame is snug. The rollers 124 will still however permit limited movement along a longitudinal (axial) axis of the frame. In effect, the deformable spacers or dampers and rollers 124 can work together to prevent damage to recreational equipment as the nautical vehicles are loaded to and from the dock 10. When the recreational equipment 20 is removed from the frame, the bias in the spacers will achieve physical equilibrium and return the spacers to a slightly more outward position.

Still further, the adjustable frame can include a sky support 126 and a seafloor support 128. The sky support 126 is a member never intended to be completely submerged in the body of water while the rack 100 is in an operating position. The seafloor support 128 is always intended to be submerged while the rack 100 is in an operating position. In some embodiments, the sky support 126 and the seafloor support 128 are fastened to the left-side depth support 104A, a right-side depth support 104B, which help extend the frame vertically to achieve extending the adjustable frame from a great height above the water 22 to a very low depth below the water 22. The fastening of these members can be by way of screws or bolts 120, as shown in FIGS. 2-3. Regarding position, the sky support 126 fastens to the left-side depth support 104A and to the right-side depth support 104B at an upper end of each, and the floor support 128 fastens to the left-side depth support 104A and to the right-side depth support 104B at a lower end of each.

Lifting Assembly of the Adjustable Rack

The lifting assembly 130 is shown throughout FIGS. 1-3. The lifting assembly 130 comprising a slider-crank mechanism to translate rotational movement of a rotatable handle 144 to linear movement of the adjustable frame, thereby allowing for a change in height of the adjustable frame with respect to the adjacent water surface 22. The slider-crank mechanism comprises a spool 132 about which a line of rope, wire or cable 138 is wound.

The hand crank 144 is an arm attached at a right angle to a rotating shaft. Circular motion is imparted to or received from the shaft. The arm may be a bent portion of the shaft, as shown in the figures, or a separate arm with a disk attached to it. Attached to the end of the hand crank 144 by a pivot is the connecting rod 134. When combined with a connecting rod 134, the hand crank 144 can be used to convert circular motion into reciprocating motion, or vice versa.

A winch is a mechanical device that is used to pull in (wind up) or let out (wind out) or otherwise adjust the tension of the rope, wire or cable 138. The winch comprises a spool (or drum) attached to the hand crank 144. The winch accumulates the rope, wire or cable 138 on the drum. The rope, wire or cable 138 can also be stored on the winch. In some embodiments, the winch can include a solenoid brake and/or a mechanical brake or ratchet and pawl which prevents it unwinding unless the pawl is retracted. An operator can turn crank handle 144 with one hand, while tailing (pulling on the loose tail end) with the other to maintain tension on the turns. Alternatively, the winch can be a self-tailing winch and can include a "stripper" or cleat to maintain tension.

The connecting rod 134 is fixedly attached to an arm of the crank 144. During operation, turning the hand crank 144 in a first direction will cause the connecting rod 134 to an arm of the crank 144 to turn the rod gear 136B. The turning of rod gear 136B will in turn cause the spool gear 136A to turn. This allows the spool 132 to rotate so that the line 138 can be extended from the spool 132 in a linear direction (i.e., in the vertical direction). This causes the entire adjustable frame to lower in height.

If the hand crank 144 is rotated in the opposite direction (i.e., a second direction), the connecting rod 134 that is fixedly attached to an arm of the crank 144 will turn the rod gear 136B in the other direction which causes the spool gear 136A to turn and allow the spool to rotate so that line 138 can be retracted into the spool 132 and thereby cause the entire adjustable frame to elevate to a greater height.

The internal gears 136A. 136B are protected from the elements by a housing or bracketry 136. The bracketry comprises steel plates on the left and right sides of the spool 132.

In the embodiments shown, the line 138 attaches to the top of the adjustable frame by way of a hook 140 at the end of the line 138 and an eye 140, which is a type of built-in anchor point that protrudes from an upper surface of the adjustable frame. It is to be appreciated some other type of anchor point (e.g., an aperture) could be employed in the adjustable frame in alternative embodiments.

Further Modifications

Additional devices can be attached the frame to allow for protection of the recreational equipment stored thereon from theft and/or from the elements. For example, additional eye(s) and/or built-in anchor points can allow external locking mechanisms, such as a bike lock or cable locks, to attach to both the frame and the recreational equipment can be located somewhere on the frame. Built-in locks can also be positioned on the frame itself.

A marine canvas can be attached to the adjustable frame and used in a similar manner to a boat cover. This can help protect the recreational equipment from sun and moisture when the recreational equipment is not in active use. The marine canvas can be constructed from many different types of materials, including but not limited to: acrylics, polyvinyl chloride (PVC) coated polyester, silicone treated substrates and many coated meshes suitable for outdoor use. The marine canvas offers good UV resistance, water/ice resistance, and wind resistance. More particularly, solution dyed acrylic canvas, PVC coated woven polyester, and other such synthetic fabrics can last for many years before deteriorating due to UV radiation. The thread used to stitch modern marine type canvas is typically made from polyester or polytetrafluoroethylene (PTFE). Nylon and natural fiber thread can also be used but offer less UV resistance comparable to Polyester or PTFE.

From the foregoing, it can be seen that the present disclosure accomplishes at least all of the stated objectives.

LIST OF REFERENCE CHARACTERS

The following table of reference characters and descriptors are not exhaustive, nor limiting, and include reasonable equivalents. If possible, elements identified by a reference character below and/or those elements which are near ubiquitous within the art can replace or supplement any element identified by another reference character.

TABLE 1

| List of Reference Characters | |
|---|---|
| 10 | dock |
| 12 | planks |
| 14 | protective plate/edge guard |
| 16 | cleat |
| 18 | bumper |
| 20 | paddleboard |

TABLE 1-continued

| List of Reference Characters | |
|---|---|
| 22 | body of water |
| 24 | dock posts |
| 26 | steps (e.g., steps of stairs, a ladder, etc.) |
| 100 | rack |
| 102S | mount: sleeve |
| 102L | mount: linking member |
| 104A | left-side depth support |
| 104B | right-side depth support |
| 106 | lower frame member |
| 108 | upper frame member |
| 110A | left frame member |
| 110B | right frame member |
| 112A | upper left arm |
| 112B | upper right arm |
| 114A | central left arm |
| 114B | central right arm |
| 116A | lower left arm |
| 116B | lower right arm |
| 118 | water-tight end caps (e.g. gaskets) |
| 120 | threaded fastener (e.g. screw, bolt) |
| 122A | auxiliary left support arm |
| 122B | auxiliary right support arm |
| 124 | rollers |
| 126 | sky support |
| 128 | seafloor support |
| 130 | lifting assembly |
| 132 | spool (wheel of pulley) |
| 134 | connecting rod |
| 136 | bracketry |
| 136A | spool gear |
| 136B | rod gear |
| 138 | line |
| 140 | hook |
| 142 | eye |
| 144 | hand crank |
| 146 | mounting aperture |
| 148 | mounting plate |

Glossary

Unless defined otherwise, all technical and scientific terms used above have the same meaning as commonly understood by one of ordinary skill in the art to which embodiments of the present disclosure pertain.

The terms "a," "an," and "the" include both singular and plural referents.

The term "or" is synonymous with "and/or" and means any one member or combination of members of a particular list.

As used herein, the term "exemplary" refers to an example, an instance, or an illustration, and does not indicate a most preferred embodiment unless otherwise stated.

The term "about" as used herein refers to slight variations in numerical quantities with respect to any quantifiable variable. Inadvertent error can occur, for example, through use of typical measuring techniques or equipment or from differences in the manufacture, source, or purity of components.

The term "substantially" refers to a great or significant extent. "Substantially" can thus refer to a plurality, majority, and/or a supermajority of said quantifiable variables, given proper context.

The term "generally" encompasses both "about" and "substantially."

The term "configured" describes structure capable of performing a task or adopting a particular configuration. The term "configured" can be used interchangeably with other similar phrases, such as constructed, arranged, adapted, manufactured, and the like.

Terms characterizing sequential order, a position, and/or an orientation are not limiting and are only referenced according to the views presented.

The term "launching" when used in connection with aquatic recreational equipment refers to, at least, setting the recreational equipment in the water, floating and/or allowing to the recreational equipment to slide into the water, and/or to send forth, propel, or otherwise release the recreational equipment in the water. Other proper uses of the verb "to launch" will be apparent to those skilled in the nautical arts.

The "invention" is not intended to refer to any single embodiment of the particular invention but encompass all possible embodiments as described in the specification and the claims. The "scope" of the present disclosure is defined by the appended claims, along with the full scope of equivalents to which such claims are entitled. The scope of the disclosure is further qualified as including any possible modification to any of the aspects and/or embodiments disclosed herein which would result in other embodiments, combinations, subcombinations, or the like that would be obvious to those skilled in the art.

What is claimed is:

1. A rack (100) for aquatic recreational equipment (20) comprising:

an adjustable frame comprising a left-side member (110A), a right-side member (110B), and at least one horizontal member (106, 108) extending from the left-side member (110A) to the right-side member (110B);

at least two pairs of opposing arms (112A-B/114A-B/116A-B) extending away from the left-side member (110A) and the right-side member (110B);

a mounting member (102S/102L) operatively attached to (i) the adjustable frame and (ii) a dock (10), said mounting member (102S/L) orthogonally oriented with respect to a plane defined by an adjacent water surface (22);

a lifting assembly (130) comprising a slider-crank mechanism (132, 134, 136, 138) to translate rotational movement of a rotatable handle (144) to linear movement of the adjustable frame, thereby allowing for a change in height of the adjustable frame with respect to the adjacent water surface (22), a left-side depth support (104A) and a right-side depth support (104B) that extend the frame to a greater submersible depth; and a sky support (126) and a seafloor support (128) that extend from the left-side depth support (104A) to the right-side depth support (104B), wherein the sky support (126) fastens to the left-side depth support (104A) and to the right-side depth support (104B) at an upper end of each, and the seafloor support (128) fastens to the left-side depth support (104A) and to the right-side depth support (104B) at an lower end of each.

2. The rack (100) of claim 1 wherein the mounting member (102S/102L) comprises a sleeve (102S).

3. The rack (100) of claim 1 wherein the mounting member (102S/102L) comprises a linking member (102L).

4. The rack (100) of claim 1 wherein the at least two pairs of opposing arms (112A-B/114A-B/116A-B) comprise three pairs of opposing arms (112A-B, 114A-B, and 116A-B).

5. The rack (100) of claim 1 wherein the at least one horizontal member (106, 108) comprise a lower frame member (106) and an upper frame member (108).

6. The rack (100) of claim 5 further comprising auxiliary, vertical support arms (122A, 122B) that from the lower member (106) to the upper frame member (108), said auxiliary, vertical support arms (122A, 122B) being more centrally located than the left-side member (110A) and the right-side member (110B).

7. The rack (100) of claim 6 further comprising horizontally oriented rollers (124) operatively attached to each auxiliary support arm (122A, 122B).

8. The rack (100) of claim 1 wherein the at least two pairs of opposing arms (112A-B/114A-B/116A-B) extend away from the adjustable frame at an angle of at least fifteen degrees above horizontal with respect to the plane defined by the adjacent water surface (22).

9. The rack (100) of claim 1 wherein the slider-crank mechanism (132, 134, 136, 138) comprises a spool (132) about which a line of rope, wire or cable (138) is wound.

10. The rack (100) of claim 9 wherein the slider-crank mechanism (132, 134, 136, 138) comprises a connecting rod (134) fixedly attached to an arm of the rotatable handle (144), wherein turning the rotatable handle (144) causes the connecting rod (134) to turn a rod gear (136B), and further wherein the turning of the rod gear (136B) causes a spool gear (136A) to turn, which in turns allows the spool (132) to rotate so that the line (138) can be extended and retracted from the spool (132) in the linear movement.

11. The rack (100) of claim 10 wherein the line of rope, wire or cable (138) attaches to an eye (142) located on the at least one horizontal member (106, 108).

12. The rack (100) of claim 1 wherein the mounting member (102S/102L) is directly attached to a post (24) of the dock (10).

13. The rack (100) of claim 12 wherein the post is a 4×4 post.

* * * * *